US005487505A

United States Patent [19]

Nilsson

[11] Patent Number: 5,487,505

[45] Date of Patent: Jan. 30, 1996

[54] ARRANGEMENT FOR A CARTON

[75] Inventor: Bo-Arne Nilsson, Mörarp, Sweden

[73] Assignee: Björkebo Gåard AB, Morarp, Sweden

[21] Appl. No.: 325,359

[22] PCT Filed: Apr. 29, 1993

[86] PCT No.: PCT/SE93/00377

§ 371 Date: Dec. 7, 1994

§ 102(e) Date: Dec. 7, 1994

[87] PCT Pub. No.: WO93/22206

PCT Pub. Date: Nov. 11, 1993

[30] Foreign Application Priority Data

Apr. 29, 1992 [SE] Sweden ..... 9201365

[51] Int. Cl.[6] ..... B65D 5/30; B65D 21/032

[52] U.S. Cl. ..... 229/191; 229/164; 229/918; 493/137; 493/162

[58] Field of Search ..... 229/164, 191, 229/915, 918; 493/137, 162, 167, 168

[56] References Cited

U.S. PATENT DOCUMENTS

| | | | |
|---|---|---|---|
| 2,350,932 | 6/1944 | Schaefer | 229/191 |
| 3,792,646 | 2/1974 | Bauer | 493/137 |
| 3,918,630 | 11/1975 | Meyers | 229/191 |
| 4,418,863 | 12/1983 | Kimbrell, Sr. | 229/191 |
| 4,546,913 | 10/1985 | Castillo | 229/191 |
| 4,613,045 | 9/1986 | Watson | 229/191 |
| 4,799,620 | 1/1989 | Vilella | 229/191 |
| 5,016,814 | 5/1991 | Fullerton . | |

FOREIGN PATENT DOCUMENTS

| | | | |
|---|---|---|---|
| 394549 | 10/1990 | European Pat. Off. | 229/191 |
| 2548626 | 5/1984 | France . | |
| 3439185 | 10/1984 | Germany . | |
| 8000753 | 10/1989 | Netherlands | 229/918 |
| 1478806 | 7/1977 | United Kingdom | 229/191 |
| 2185964 | 8/1987 | United Kingdom . | |
| 2264484 | 9/1993 | United Kingdom | 229/191 |
| 8605159 | 9/1986 | WIPO . | |

*Primary Examiner*—Gary E. Elkins
*Attorney, Agent, or Firm*—Browdy and Neimark

[57] ABSTRACT

An arrangement in a box is disclosed, the box being, in the initial position, in the form of a sheet-like blank having a bottom (2), first and second sidewalls (4, 6) which are connected to the bottom (2) via fold lines (8, 10) and are substantially parallel panels which are connected to one of the sidewalls (4, 6). The arrangement is characterized in that a flap (32) is formed at a second panel (20) which, via a second fold line (18), is connected to a first, inner panel (16) which is connected to one of the sidewalls (4, 6) via an inner fold line (14), and that a slot (34) is formed in one sidewall (6) connected to the inner panel (16), the slot engaging the flap (32) when the box is erected.

18 Claims, 2 Drawing Sheets

ARRANGEMENT FOR A CARTON

BACKGROUND OF THE INVENTION

1. Technical Field

The present invention generally relates to an arrangement in a box, and more specifically concerns a corner structure in an open-top, stackable box, especially intended for vegetables.

2. Prior Art

In recent years, the trend in agriculture has been towards increased automatisation when sowing or planting as well as harvesting vegetables. When harvesting vegetables, modern farms thus use reapers with packing stations, where the vegetables are directly packed in bags or boxes of various sorts. Mostly, the vegetables are then taken directly to a cold storage, to be distributed later on to wholesale or retail dealers.

In harvesting, many vegetables, such as iceberg lettuce, are handled manually, i.e. the vegetable is manually handled and placed in a box. Usually, the boxes are open at the top and of such dimensions that four corner-to-corner boxes cover the surface of a loading pallet. The boxes are in addition stackable, so that a loading pallet holds about 40 boxes filled with vegetables, such as iceberg lettuce.

When harvesting e.g. iceberg lettuce, one therefore has to use many loading pallets and a great number of boxes. Conveniently, the boxes are in the form of blanks which are successively erected and filled with vegetables. Since a high and even harvesting rate is desirable, the vegetable boxes have to be erected fairly quickly, and the number of operations required for doing this should therefore be limited. At the same time, however, the vegetable box, usually made of environment-friendly paperboard, has to be stable and stackable to a considerable height. Alternatively, a plurality of machine-erected boxes can be brought along and successively filled and placed on the loading pallet supporting the boxes.

GB-A-2,185,964 teaches such a box, in which triangular vertical corner areas are obtained when erecting the box, a stabilising triangular plastic part being applied on the upper ends of the corner areas. Apart from the fact that a great many plastic parts have to be brought to the harvesting site (about 160 plastic parts are required for a loading pallet with iceberg lettuce), several drawbacks are associated with this box structure. Moreover, the use of plastic materials should be restricted for environmental reasons.

The GB box structure with mounted plastic parts or knobs is very stable when loaded in the vertical direction. However, if the box is exposed to transverse forces, as is usually the case when the filled vegetable box is lifted to be placed on the loading pallet or on another box, the bottom and the side walls of the box are deformed, frequently causing the plastic knob to slide upwards and fall off. Should two or more plastic knobs fall off, which is not uncommon, the erected vegetable box becomes unstable and runs the risk of collapsing.

Apart from this serious disadvantage impairing the GB vegetable box, applying the plastic knobs out in the fields means extra work. It should also be observed that the container for the plastic parts takes up quite a lot of space in the fairly restricted packing station.

Another aspect is that plastic parts may be lost, either when erecting the box and applying the plastic knobs or when the box is unevenly loaded, as described above.

Usually, the plastic knobs fall to the ground and are, for various reasons, seldom picked up after the harvest to be reused or destroyed. Instead, there is a considerable risk that the plastic parts be ploughed into the ground, where they remain. Not being degradable, or only slowly so, the plastic parts constitute an environmental hazard. The plastic knobs are a problem also when the used vegetable boxes are to be destroyed, since they then have to be removed and somehow taken care of.

In addition to the serious drawbacks mentioned above, prior-art vegetable boxes suffer from other disadvantages. The box disclosed in U.S. Pat. No. 5,016,814 is unsuitable for use in a cold storage owing to the design of its side walls, the boxes preventing the cooling air from circulating between the stacked boxes.

Also the box taught in FR-A1-2,548,626 is unsuitable for use in a cold storage where cold air is passed between the stacked boxes. If cooled air is passed across the long-side walls, it is a disadvantage if the air can pass out via the short-side walls of the boxes.

The stackable container known from DE-A1-34 39 185 is interesting in many ways. This container has the advantage of a stable structure. However, a serious drawback is that, in order to obtain the aimed-at stacking stability, it implies the use of plastic materials, such as polyethylene, polyester and polypropylene, i.e. the container and the corner structure described in the DE specification cannot be durably made of paperboard or corrugated board. As indicated in the foregoing, the use of plastic materials should, however, be avoided whenever possible. To become sufficiently strong, the DE container is, in addition, provided with substantially horizontal panels extending inwards towards the erected container, which however makes it more difficult to put the vegetables in the container.

SUMMARY AND OBJECT OF THE INVENTION

One object of the present invention is, therefore, to provide an open-top box of paperboard or corrugated board, or some other degradable material, which is intended primarily for vegetables and has a corner structure imparting a high degree of stability to the box, also when unevenly loaded.

Another object of the invention is to provide a box of paperboard or corrugated board, or some other degradable matarial, which is primarily intended for vegetables and can be rapidly erected when the vegetable at issue is harvested.

A further object of the invention is to provide a box of paperboard or corrugated board, or some other degradable material, which is primarily intended for vegetables and is made in one piece and to which no loose parts, such as metal staples and plastic knobs, have to be applied to impart the desired stability.

The inventive vegetable box should otherwise meet the requirements placed on known boxes, i.e. all the boxes should have the same outer dimensions and be stackable. In addition, the inventive box should permit the cooling air in a cold storage to flow more efficiently.

According to the invention, these and other objects are attained by an arrangement in a box, preferably a vegetable box.

BRIEF DESCRIPTION OF THE DRAWINGS

Currently preferred embodiments of the invention will now be described in more detail with reference to the accompanying drawings, in which.

DETAILED DESCRIPTION OF THE PREFERRED EMBODIMENT(S)

Figure 1:
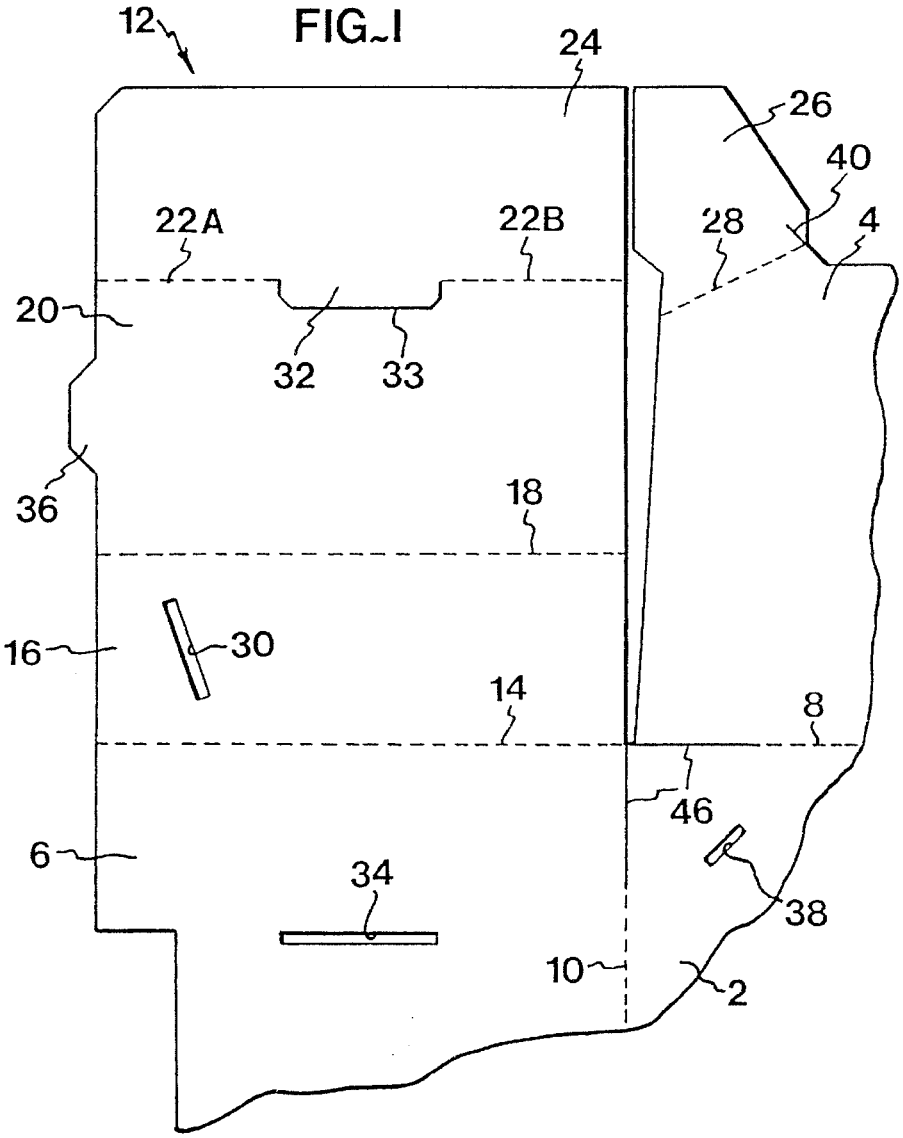
FIG. 1 is a partial top plan view showing a corner of a box blank that, when erected, forms the inventive transportation box.

FIG. 1 illustrates one of four corner areas of a sheet-like blank, i.e. whose vertical extent is negligible as compared with its horizontal extent, the blank forming, when erected, an inventive box, preferably for vegetables. Apart from the inventive corner structure to be described in more detail below, the box comprises, in known manner, a bottom 2, two long-side walls 4 which are substantially vertical when erected and of which but one is partially illustrated, and two short-side walls 6 which are substantially vertical when erected and of which but one is partially illustrated. The short-side walls 6 are connected to the bottom 2 via fold lines 8 and 10. To make the erected box very stable, the invention provides a corner structure 12 which interconnects a long-side wall 4 and a short-side wall 6 of the erected box in stable and reliable manner.

The corner structure 12 comprises three panels, namely an inner panel 16 connected to one short side of the short-side wall 6 via a fold line 14, a second panel 20 connected to the inner panel 16 via a fold line 18 parallel to the fold line 14, and an outer panel 24 connected to the second panel 20 via fold lines 22A and 22B parallel to the fold lines 14 and 18. The length, or rather the height when erected, of these panels is substantially identical with that of the short-side wall 6 and exceeds that of the long-side wall 4, for reasons to be given further below. In the embodiment illustrated, the inner panel 16 and the outer panel 24 are substantially of equal width, whereas the width of the second panel complies with Pythagoras' theorem and thus equals the square root of the sum of the square of the width of the inner and outer panels 16 and 24, respectively. It should here be pointed out that the outer panel may alternatively be in the form of a flap, as in the embodiment described with reference to FIG. 4 further below.

To fix the corner structure and provide a stable connection to the long-side wall 4 and the short-side wall 6, provision is made of a plurality of flaps cooperating with slots. In the immediate vicinity of each outer corner of the long-side walls 4, there is provided a first flap 26 which is connected to the long-side wall 4 via a fold line 28. Preferably, the fold line 28 forms an angle of about 30° with the upper edge of the long-side wall 4. A first slot 30 is formed in the inner panel 16 at a corresponding distance from the outer edge and correspondingly oriented. A second flap 32 is formed in the second panel 20 and is rigidly connected to the outer panel 24. The second flap 32 is provided by making a U-shaped slit 33 in the second panel 20 so that the ends of the slit 33 merge into the fold lines 22A and 22B, while being at substantially right angles to the branches of the U-shaped slit. A second slot 34 is formed in the short-side wall 6 at a corresponding distance from the fold line 14 and correspondingly oriented. In practice, the distance between the second slot 34 and the fold line 14 thus is substantially equal to the width of the outer panel 24, i.e. the width between the fold lines 22A, 22B and the outer edge of the outer panel 24 parallel thereto.

To make the boxes stackable, the edge of the second panel 20 facing away from the long-side wall 4 is provided with a tab or extension 36, preferably with bevelled corners, and a slot 38 is formed in the bottom 2, at a corresponding distance from the corner area of the bottom 2 and correspondingly oriented, and is intended to cooperate with a corresponding tab or extension 36 of the box below.

As mentioned above, four boxes preferably form a tier on a loading pallet. The four adjoining corner areas are locked to one another by a ring (not shown) passed into a recess 40 in the short-side wall 6 of each box.

When harvesting e.g. iceberg lettuce, one brings along loading pallets and unfolded blanks which are successively erected and filled with vegetables. Then, the boxes are placed on a loading pallet or on top of one another. When erecting such a vegetable box, the outer panel 24 is first folded so far in towards the second panel 20 that it almost comes to rest on this panel. Then, the second flap 32 connected to the outer panel 24 is swung approximately 180° to be directed away from the short-side wall 6 in the end position. The second panel 20, on which the outer panel 24 is folded, is then folded in towards the inner panel 16, so that the outer panel 24 is placed substantially halfway between the second panel 20 and the inner panel 16. The second flap 32 has then been swung approximately another 180° and now occupies a position in the immediate vicinity of the second slot 34. By slightly pivoting the inner panel 16 along the fold line 14, the second flap 32 is pivoted a few degrees more and can easily be pushed through the slot 34, while at the same time the outer panel 24 is released and, owing to the properties of the material, springs back somewhat to be finally applied against the inside of the short-side wall 6 between the second slot 34 and the fold line 14. After this has been done to all the corners of the box, the short-side walls 6 are folded upwards. The first flap 26 of the long-side walls 4 is folded inwards or downwards and is, after the side-walls have been erected, pushed through the first slot 30 in the inner panel 16. The flap 26 is thus pressed downwards, and recess 40 comes into engagement with the edge of the slot 30, locking the flap 26 in the end position and thus preventing any motion of the outer panel 24 in towards the second panel 20, while at the same time the flap 26 is clamped against the second panel 20.

Figure 2:
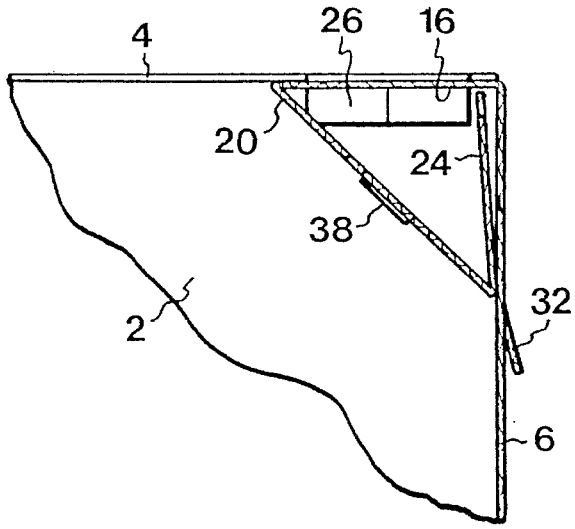
FIG. 2 is a partial top view showing a corner of the transportation box in FIG. 1 when erected.
Figure 3:
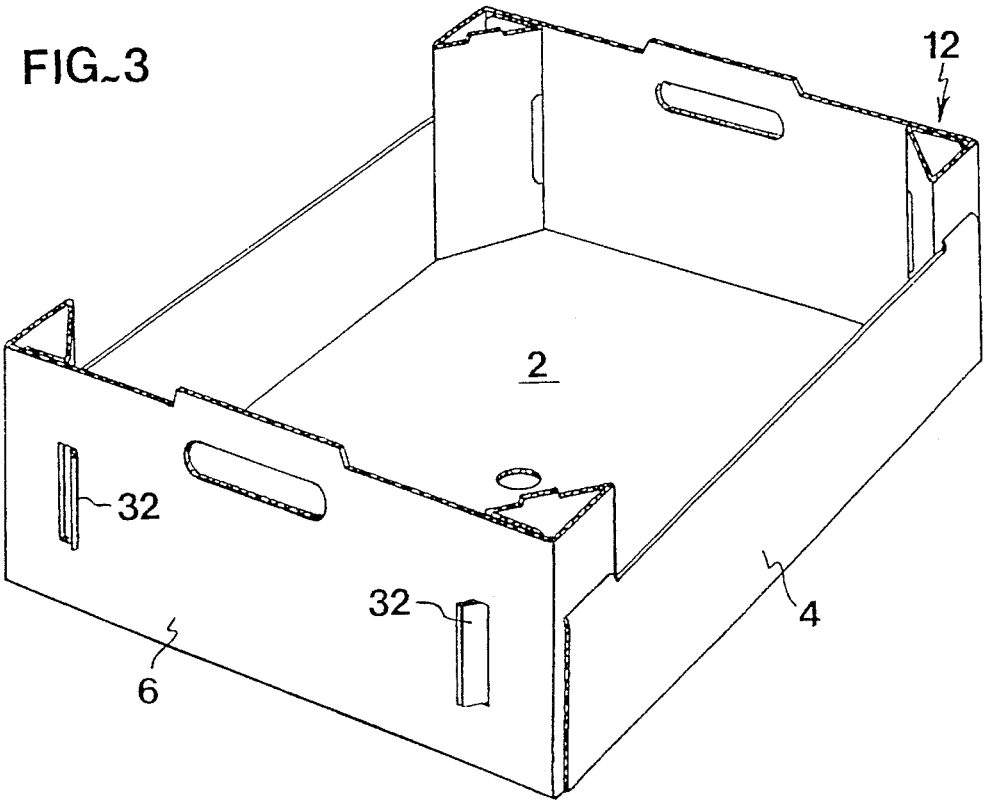
FIG. 3 is a perspective view of the inventive transportation box when erected.
Figure 4:
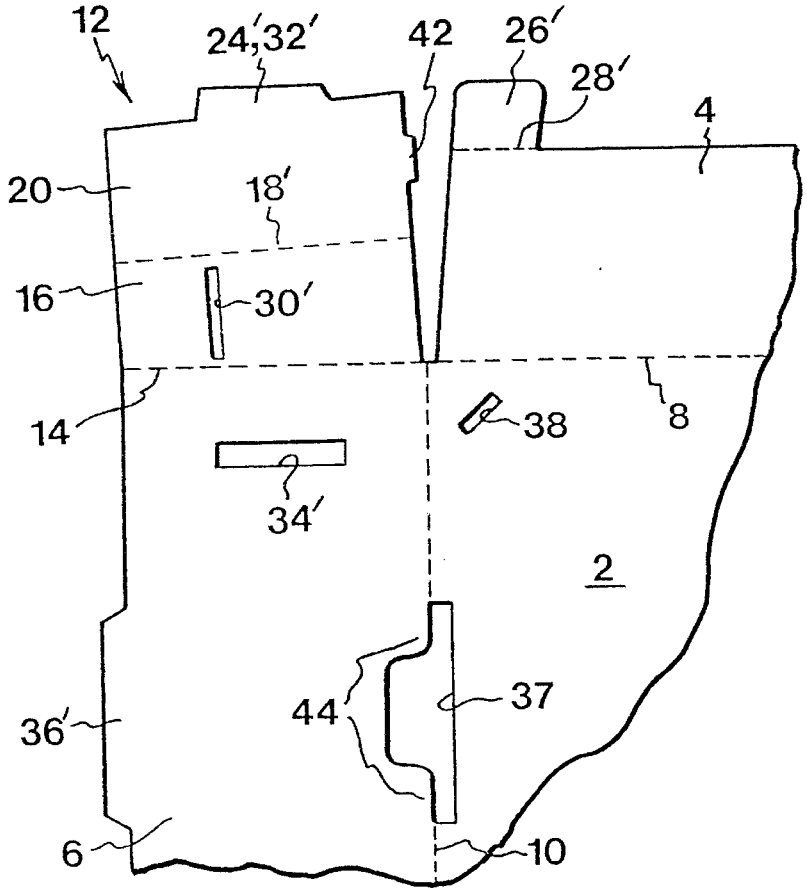
FIG. 4 is a partial top plan view showing a corner of another blank that, when erected, forms the inventive transportation box.

FIG. 4 illustrates another embodiment of one out of four corner areas of a sheet-like blank which, when erected, forms an inventive box, preferably for vegetables. Like details as in FIGS. 1–3 are identified by like reference numerals.

Apart from the inventive corner structure described further below, the box comprises, in known manner, a bottom 2, two long-side walls 4 which are substantially vertical when erected and of which but one is partially illustrated, and two short-side walls 6 which are substantially vertical when erected and of which but one is partially illustrated. The short-side walls 6 are connected to the bottom 2 via fold lines 8 and 10. To make the erected box very stable, the invention provides a corner structure 12 which interconnects one long-side wall 4 and one short-side wall 6 of the erected box in stable and reliable manner.

The corner structure 12 comprises three panels, namely an inner panel 16 connected to one short-side of the short-side wall 6 via a fold line 14, a second panel 20 connected to the inner panel 16 via a fold line 18' parallel to the fold line 14, and a rigid outer panel 24' connected to the second panel 20.

Preferably, the fold lines 14 and 18 each form an angle with the fold line 8 to make the long-side and short-side walls 4, 6 incline slightly inwards when the box is erected, thereby increasing its stackability. The length, or rather the height when the box is erected, of the inner and outer panels 16, 20 is substantially identical with that of the short-side wall 6 and exceeds that of the long-side wall 4, thereby improving the flow-through of cooling air in a cold storage. In the embodiment illustrated here, the width and the length of the outer panel 24' are so reduced that there is formed a flap 32' which is fixedly connected to the second panel 20, whereas the width of the second panel 20 substantially equals the square root of the sum of the square of the double width of the inner panel 16.

In order to fix the corner structure and provide a stable connection to the long-side wall 4 and the shortside wall 6, provision is made of several slots and an additional flap. In the immediate vicinity of each outer corner of the long-side walls 4, there is provided a flap 26' which is connnected to the long-side wall 4 via a fold line 28'. Here, the fold line 28' extends in the same direction as the upper edge of the long-side wall 4. An elongate slot 30' is formed in the inner panel 16 at a corresponding distance from the outer edge and at an angle to the fold line 10. The outer panel 24' is intended to cooperate with a second slot 34' which is formed in the shortside wall 6 at a corresponding distance from the fold line 14 and is correspondingly oriented.

To make the boxes stackable, the upper edge of the short-side wall 6 is provided with a tab or extension 36, preferably with bevelled corners, and a mating recess 37, cooperating with the tab or extension of a box below, is formed in the bottom 2 and the edge of the short-side wall 6 facing the bottom 2. A tab 42 is provided on the edge of the second panel 20 facing away from the upper edge and is intended to cooperate with a recess 38 formed in the bottom 2 at a corresponding distance from the corner area, thereby to stabilise this area.

Also in the embodiment illustrated in FIG. 4, the corner area has a substantially triangular cross-section. By inclining the long-side and short-side walls in towards the centre of the box, the forces acting on the box are directed inwards and the stackability of the box is increased.

The triangular cross-section of the corner structure according to the first and the second embodiment results in a very high stackability, while at the same time the interlocking of the flaps and the inclination of the walls in towards the centre of the box provide a high degree of stability, also for considerable lateral or transverse forces. Tests have shown that the corner structures locked as described above remain locked, also when subjected to extremely rough handling, and that it is the material itself that is ultimately destroyed.

Thus, the invention provides a box of high stability, also when subjected to considerable uneven load, without the use of any loose parts, such as metal staples. The inventive arrangement enables the box to be rapidly erected by a few simple operations or with the aid of a simple device. Thus, the inventive arrangement is especially suitable for use in a mobile packing station when harvesting vegetables to be packed in boxes. Because two parallel side walls, in this instance the short-side walls, are higher than the other two side walls, the flow of cooling air in a cold storage is considerably improved.

It goes without saying that the embodiment described can be modified in certain ways. Thus, the corner structure may be a polygon having more than three sides. However, this solution has the disadvantage of requiring a larger material consumption without increasing the stability or the durability of the box. All variants and modifications encompassed by the inventive idea fall within the scope of the appended claims.

I claim:

1. An arrangement for a box in the form of a flat blank when in an initial position of the box, said arrangement comprising a bottom (2), a pair of first side walls and a pair of second side walls (4, 6), each side wall of each pair of said side walls being respectively connected to the bottom (2) via fold lines (8, 10) and being substantially vertical when erected, a plurality of substantially parallel panels connected to each of one pair of said side walls (4, 6), wherein a first flap (32) is formed by a second panel (20) of said plurality of substantially parallel panels, the second panel being connected to a first inner panel (16) of said plurality of substantially parallel panels by a second fold line (18), the first inner panel being connected to each of the one pair of said side walls (4,6) by an inner fold line (14), wherein the second panel has a width along the longitudinal length of said plurality of substantially parallel panels greater than the first inner panel of said plurality of substantially parallel panels, and wherein a first slot (34) is formed in each of the one pair of said side walls (4, 6) connected to the first inner panel (16), said first slot (34) engaging the first flap (32) when the box is erected, wherein a second flap (26) is formed at an upper edge of another pair of said side walls (4, 6), and that a second slot (30) provided in the inner panel (16) to allow the second flap (26), after being bent along a fold line (28), to be connected to said second slot (30), wherein a triangular column is formed at each of four corners of an erected box by one side wall of each pair of said side walls (4, 6) and the second panel.

2. An arrangement as claimed in claim 1, wherein the inner fold line (14) and the second fold line (18), respectively in the initial position of the box form an angle with the fold line (8) between the second side walls (4) and the bottom (2).

3. An arrangement as claimed in claim 1, wherein an outer panel (24) is connected to the second panel (20) via two fold lines (22A, 22B), said first flap (32) being formed by the provision of a substantially U-shaped slot (33) which extends in the second panel (20) and begins at one fold line (22A) of said two fold lines and ends at another fold line of said two fold lines (22B) and that said flap (32), thus is fixedly connected to the outer panel (24).

4. An arrangement as claimed in claim 3, wherein said second flap (26) has a slit (40) having an edge engaging an edge of said second slot (30) when the box is erected.

5. An arrangement as claimed in claim 4, wherein the second panel (2) has, at an edge facing away from said second side walls (4) in the initial position of the box, a tab or extension (36), and that the bottom (2) has a slot (38) adapted to cooperate with a corresponding tab or extension of an erected box below.

6. An arrangement as claimed in claim 4, wherein the second panel (20) has, at an edge facing said second side walls (4) in the initial position of the box, a tab or extension (42) and that the bottom (2) has a slot (38) adapted to cooperate with said tab or extension (42).

7. An arrangement as claimed in claim 6, wherein the first side walls (6) have a tab or extension (36) projecting from an upper edge, and that the bottom (2) and an edge of the first side walls (6) facing the bottom (2) have an opening or recess (37) adapted to respectively cooperate with each tab or extension (36) of the first side walls of an erected box below, each said tab or extension (36) being brought into engagement behind flaps (44) of the recess (37).

8. An arrangement as claimed in claim 7, wherein each of said fold lines (8, 10) respectively between said side walls (4, 6) and the bottom (2) have a slit (46) in the immediate vicinity of each corner, to allow a corner structure formed when the box is erected to be supported by the bottom (2), along the side walls (4, 6).

9. An arrangement as claimed in claim 1, wherein said flap (26) has a recess (40) whose edge engages an edge of said slot (30) when the box is erected.

10. An arrangement as claimed in claim 1, wherein the second panel (20) has, at an edge facing away from said second side walls (4) in initial position of the box, a tab or extension (36), and that the bottom (2) has a slot (38) adapted to cooperate with a corresponding tab or extension of an erected box below.

11. An arrangement as claimed in claim 1, wherein in that the second panel (20) has, at an edge facing said second side walls (4) in the initial position of the box, a tab or extension (42), and that the bottom (2) has a slot (38) adapted to cooperate with said tab or extension (42).

12. An arrangement as claimed in claim 1, wherein each of said fold lines (8, 10) respectively between said side walls (4, 6) and the bottom (2) have a slit (46) in the immediate vicinity of each corner, to allow a corner structure formed when the box is erected to be supported by the bottom (2) and the side walls (4, 6).

13. An arrangement as claimed in claim 2, wherein said flap (26) has a recess (40) whose edge engages an edge of said slot (30) when the box is erected.

14. An arrangement as claimed in claim 2, wherein the second panel (20) has, at an edge facing away from said second side walls (4) in the initial position of the box, a tab or extension (36), and that the bottom (2) has a slot (38) adapted to cooperate with corresponding tab or extension of an erected box below.

15. An arrangement as claimed in claim 2, wherein the second panel (20) has, at an edge facing said second side walls (4) in the initial position of the box, a tab or extension (42), and that the bottom (2) has a slot (38) adapted to cooperate with said tab or extension (42).

16. An arrangement as claimed in claim 2, wherein each of said fold lines (8,10) between each side of the side walls (4, 6) and the bottom (2) have a slit (46) in the immediate vicinity of each corner, to allow the corner structure formed when the box is erected to be supported by the bottom (2) along the side walls (4, 6).

17. The arrangement as claimed in claim 1, wherein the height of the pair of first side walls from the bottom (2) is different from the height of the pair of second side walls from the bottom (2).

18. A method for creating a box from an arrangement in the form of a flat blank when in an initial position of the box, said arrangement comprising a bottom (2), a pair of first side walls and a pair of second side walls (4, 6), each side wall of each pair of said side walls being respectively connected to the bottom (2) via fold lines (8, 10) a plurality of substantially parallel panels connected to each of one pair of said side walls (4, 6), wherein a first flap (32) is formed by a second panel (20) of said plurality of substantially parallel panels, the second panel being connected to a first inner panel (16) of said plurality of substantially parallel panels by a second fold line (18), the first inner panel being connected to each of the one pair of said side walls (4, 6) by an inner fold line (14), wherein the second panel has a width along the longitudinal length of said plurality of substantially parallel panels greater than the first inner panel of said plurality of substantially parallel panels, and wherein a first slot (34) is formed in each of the one pair of said side walls (4, 6) connected to the first inner panel (16), wherein a second flap (26) is formed at an upper edge of another pair of said side walls (4, 6), and that a second slot (30) provided in the inner panel (16), said method comprising the steps of:

folding each said second panel (20) along said second fold line (18) toward said first inner panel (16), then folding each said first inner panel (16) with the second panel (20) thereon, along said inner fold line (14) towards each one side wall of said one pair of said side walls (4, 6), pushing each said first flap (32) through each said first slot (34) in said each one side wall of said one pair of said side walls, folding from said bottom (2) said each side wall of each pair of said side walls (4, 6), folding inwards the second flap (26) and inserting the second flap (26) through the second slot (30) while at the same time pushing said second flap downwards.

* * * * *